United States Patent [19]

Thomasson

[11] Patent Number: 4,932,182

[45] Date of Patent: Jun. 12, 1990

[54] FLOOR TILE FORMING AND STRUCTURAL UNDERLAYMENT DEVICE

[76] Inventor: John R. Thomasson, 5203 88th, Lubbock, Tex. 79424

[21] Appl. No.: 433,857

[22] Filed: Nov. 9, 1989

[51] Int. Cl.[5] ..... E04F 15/14

[52] U.S. Cl. ..... 52/318; 52/387; 52/601; 404/18

[58] Field of Search ..... 52/318, 315, 387, 391, 52/601, 444, 443, 181; 404/42, 44, 18, 28, 31, 34

[56] References Cited

U.S. PATENT DOCUMENTS

| | | | |
|---|---|---|---|
| 2,030,556 | 2/1936 | Veltung | 52/318 |
| 3,025,772 | 3/1962 | Palatini | 52/318 X |
| 3,338,014 | 8/1967 | Waite | 52/318 X |
| 3,533,206 | 7/1968 | Passeno, Jr. | 52/391 X |
| 4,601,150 | 7/1986 | Dougherty | 52/318 X |
| 4,858,410 | 8/1989 | Goldman | 52/387 X |

*Primary Examiner*—Carl D. Friedman

*Assistant Examiner*—Linda Jean Hoffert

[57] ABSTRACT

A one piece molded plastic sheet is glued to a floor surface and properly fastened. As many more molded sheets are added to the first in building a complete coverage over the surface. A loose grout material is placed over the molded sheet and into numerous shallow enclosures which consist of a network of raised ribbing that intersect to form a variety of shapes and patterns on the surface. The grout material is levelled off at the top of the raised ribbing so the rib top would appear to be the grout fill characteristic of conventional tile. As the tiles which were formed from the fill material is hardened it is bonded to the molded sheet by special entrapping designs in the mold that prohibit its release. The device serves to structurally support the subfloor by being bonded to the subfloor covering its surface with a strong plastic that supports the subfloors lateral movement.

9 Claims, 1 Drawing Sheet

FLOOR TILE FORMING AND STRUCTURAL UNDERLAYMENT DEVICE

BACKGROUND OF THE INVENTION

1. Field Of The Invention

This invention relates to cast-in-place flooring tile as a decorative item as well as a structural support.

Specifically, a device that is affixed to a floor and that receives a concrete base grout material on, and into, a pre-spaced and positioned form which consists of a variety of shapes and patterns resembling conventional floor tile and pavers.

2. Prior Art

Heretofore, floor tile of a variety of material makeup has been placed over and onto existing floor surfaces as a means of enhancing the look and wearability of both indoor and outdoor surfaces.

Most conventional methods use a manufactured product that is comprised of such rigid materials as to be highly subject to breakage, from manufacturer to final destination, and in its application process.

When applying conventional floor tile, special cutting of material is needed for the tile to conform to irregular areas of the floor underneath. This step is time consuming and results in the waste of material.

In the laying out of a pattern of tile, the applicator must methodically preposition a series of tiles, to determine proper spacing and alignment before actually setting the tile for permanent positioning. This procedure takes time and precise calculation.

With many conventional tiles, there is the need for grouting the space between each tile. This is yet another step in a time consuming variety of steps. Grouting consists of spreading in loose cement material over each line and into this void space. The excess residue left on top of the tile must be thoroughly cleaned; and, in tile that have rough or absorbent surfaces, this procedure can be quite time consuming and laborious.

Although most conventional floor tile renders an abrasive resistance to normal foot traffic, they do little or nothing to retard the cracking or separating on the surface of the sub-floor.

If the sub-floor is caused to crack due to the movement of earth below, the tile on the surface will also crack.

OBJECTS AND ADVANTAGES

Accordingly, several objects and advantages of my invention are:

A device that can quickly and easily be secured to, and conform to, a floor surface of a variety of compositions; which can receive a grout material in spread form; and which when cured, and hardened will resemble in appearance and durability, a variety of conventional flooring materials in a variety of shapes and sizes and colors.

This too can be achieved without the need for space fill between the tiles, since this device carries its own preformed space fill by its design.

Because of its underlayment design, this device acts as a support for the lateral stabilization of the surface that it covers in a continuous grouping and placement of numerous devices.

When covering irregular areas, the device itself can be cut to conform, instead of cutting individual forms. This device is comprised of many forms, and filling of the forms is only done after the device is seated; thus, there is no excess material to be wasted.

When preparing the placement of tile, time and need for precise measurements are conserved because the units to deal with are much larger and contain their own prespacing.

DRAWING FIGURES

Figure 1:
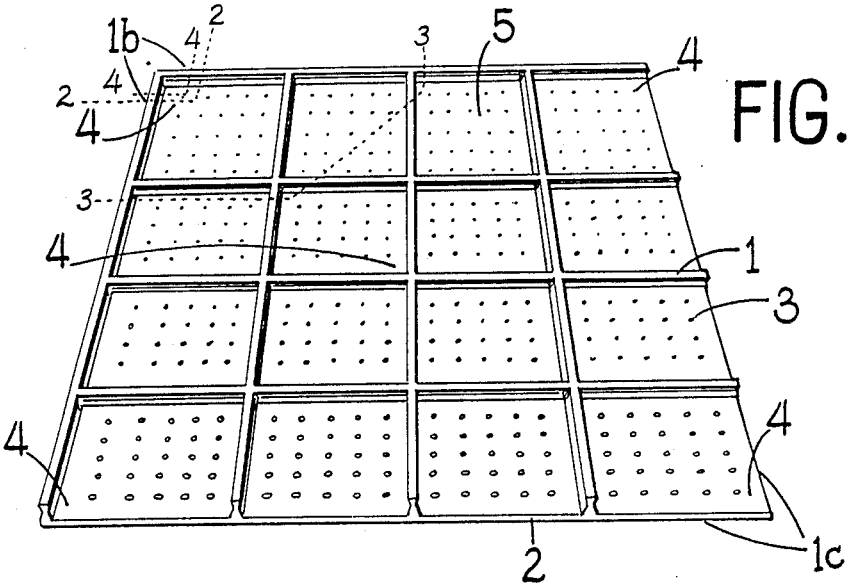
FIG. 1 shows perspective top elevational view of the one piece device according to the invention.
Figure 2:
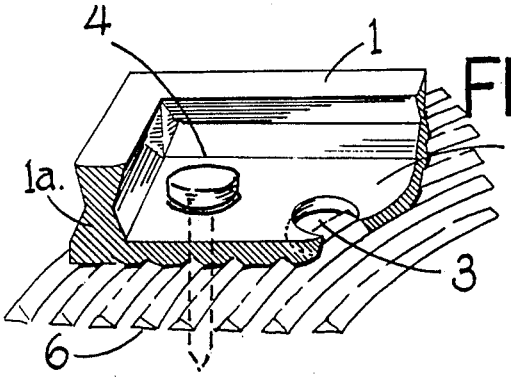
FIG. 2 shows a sectional perspective enlargement of such device taken along line 2—2.

FIG. 1*a* shows the device in a profile view.

DRAWING REFERENCE NUMERALS:

1*a*. hourglass profile design of ribbing
1*b*. adjoining edges with ribbing
1*c*. adjoining edges without ribbing
1. ribbing
2. device floor
3. perforations with flare design
4. position for subfloor fasteners
5. grid openings
6. construction adhesive
7. cement base grout fill
9. concrete subfloor
10. cracks in subfloor
11. earth
12. grout entrapment detail in ribbing
13. grout entrapment detail in base

DETAILED DESCRIPTION

As shown in FIG. 1, the one piece molded plastic sheet device in accordance with the present invention includes appropriate dimensions as to contain a number of patterns of various shapes and sizes.

These various shapes are formed by a network of raised ribbing 1 that intersect to form a closed design 5. The shape of this ribbing in profile view 1a is of an hourglass design. The raised ribbing is left open on two adjoining outer edges. 1*c*

The base or floor of the device 2 is a flat surface comprised of a number of dispersed perforations 3 with a flared opening to the underside of the device 3.

OPERATION OF INVENTION

Figure 5:
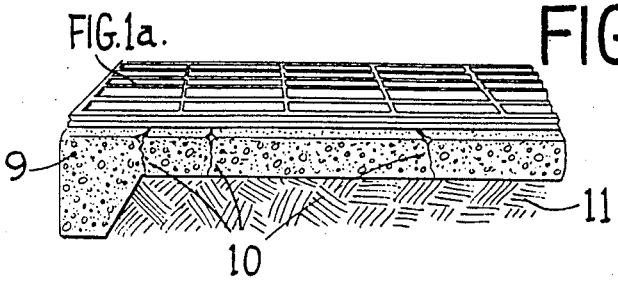
FIG. 5 shows a profile perspective of the device over concrete subfloor.

The first operation of the invention is to be placed onto and made to permanently adhere to a floor surface of various material makeup. FIG. 5

This is first done by applying a bed of construction adhesive over the floor surface 6. The molded sheet device FIG. 1 is then positioned over and onto a predetermined area in relation to a design to cover the floor surface with a particular pattern of shapes. The sheet device is further connected to the floor surface by driving appropriate fasteners through each corner, one near the center of the sheet device, and into the surface below. 4

Figure 3:
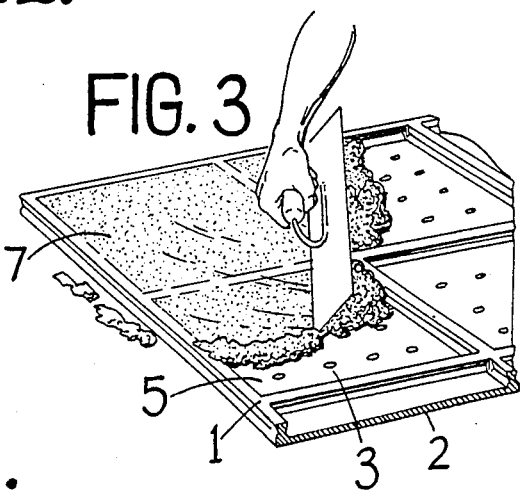
FIG. 3 shows a sectional perspective enlargement of the device with grout filling procedure, taken along line 3—3.
Figure 4:
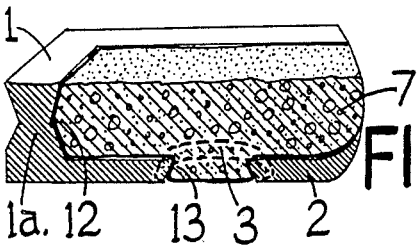
FIG. 4 shows a sectional perspective enlargement and end view of the device with grout fill in place, taken along line 4—4.

The next operation of this device is to receive a cement based grout material onto and into the grid openings on the surface of the sheet Fig.3. Once the grout material is hardened, it is secured to the device by the design of the ribbing FIG. 4 which prohibits the upward release of the hardened material from the device by allowing the mix to be wider in the middle portion of its profile, than at the top, or open side. 12

Further bonding is achieved by the same function of the perforations located on the floor of the device 3 which traps the grout material beneath the opening of the hole.

By the design of the device; and, more particularly, the absence of exterior edging of ribbing on two adjoining sides 1*c* is so that additional devices may be laid side to side where a side with outside ribbing 1*b* will become the proper ribbing to, when joined with the edge void of edge ribbing 1*c*, and enabling the expansion of devices as to cover without break of design an infinite area of floor space.

I claim:

1. A floor tile form, and structural underlayment device comprising;

a one piece molded sheet of durable plastic of appropriate dimensions as to contain a number of grid openings, a network of raised ribbing on face of said molding sheet, with an hourglass profile design, that are interconnected on said molded sheet to form numerous said grid openings, a void of said ribbing on the outer edge of two adjoining sides of said molded sheet for the purpose of aligning and joining of additional said molded sheets in expansion of coverage by numerous said molded sheets, a plurality of perforations of adequate size as to allow the passage of fill material, on the floor face of said molded sheet, each perforation opening from the top of said molded sheet through, and to the bottom of said molded sheet, in which the said opening is flared from the top of said opening to the bottom side of said molded sheet 2. A molded sheet device as defined in claim 1 which said molded sheet is made to adhere to a subfloor of various material makeup by the application of construction adhesive by means of a notched trowel over said subfloor in which said molded sheet is then placed.

3. A molded sheet device is defined in claim 1 in which said molded sheet is further bonded to said subfloor by driving appropriate fasteners through said molded sheet and into said subfloor, at points near the corners of said molded sheet, and again near the center of said molded sheet.

4. A molded sheet device as defined in claim 1 in which said grid openings formed by the said network of said ribbing may constitute a variety of shapes and designs, an in a variety of sizes.

5. A molded sheet device as defined in claim 1 in which a cement based grout material is applied over and into said enclosed patterns which said grout is leveled to the top face of said ribbing but not covering top face of said ribbing, as to give said top face of said ribbing the same appearance of grout used in conventional tile that require a filling material into space left between each said tile after it is laid.

6. A molded sheet device as defined in claim 5 in which said cement based grout is caused to be entrapped in said enclosed pattern due to its said hourglass profile design which prohibits the release from said molded sheet of said cement based grout, when it becomes hardened.

7. A molded sheet device as defined in claim 5 in which said cement based grout is further caused to become entrapped underneath said perforations because of said flare design of said opening, which prohibits said cement based materials released from said molded sheet device when hardened.

8. A molded sheet device as defined in claim 5 in which said cement based grout is of a variety of colors and shades of colors.

9. A molded sheet device as defined in claim 2 in which said molded sheet is made to adhere to said subfloor, in which the said adjoining of numerous said molded sheets , is caused to create a solid overlay of durable material in which will, by its lateral strength create a bonding in a lateral formation to the said subfloor, thus inhibiting the cracking and separation of both said subfloor as well as said cement based grout when hardened, due to movement of earth beneath the said subfloor.

* * * * *